US005358057A

United States Patent [19]

Peters et al.

[11] Patent Number: 5,358,057

[45] Date of Patent: Oct. 25, 1994

[54] MODULAR DEVICE FOR COLLECTING MULTIPLE FLUID SAMPLES FROM SOIL USING A CONE PENETROMETER

[75] Inventors: John F. Peters; Daniel A. Leavell; Landris T. Lee; Stafford S. Cooper; Philip G. Malone; Richard W. Peterson, all of Vicksburg, Miss.

[73] Assignee: U.S. Army Corps of Engineers as represented by the Secretary of the Army, Washington, D.C.

[21] Appl. No.: 158,231

[22] Filed: Nov. 10, 1993

[51] Int. Cl.[5] ..... E21B 49/08

[52] U.S. Cl. ..... 175/20; 73/864.64; 73/864.74; 166/163; 166/169; 175/59

[58] Field of Search ..... 175/20, 324, 59; 166/169, 165, 164, 163, 264; 73/864.64, 864.74

[56] References Cited

U.S. PATENT DOCUMENTS

| | | | |
|---|---|---|---|
| 2,664,269 | 12/1953 | Knight et al. | 175/20 |
| 2,941,405 | 6/1960 | Southwick | 166/164 |
| 3,036,638 | 5/1962 | Parsons | 175/20 X |
| 3,095,930 | 7/1963 | Kisling, III | 166/163 |
| 3,306,110 | 2/1967 | Woods | 175/20 |
| 3,356,137 | 12/1967 | Raugust | 166/264 |
| 3,367,188 | 2/1968 | Robinson | 175/20 |
| 3,968,682 | 7/1976 | Saint Remy Pellissier | 73/84 |
| 4,359,110 | 11/1982 | Peterson | 175/20 |
| 4,367,647 | 1/1983 | Barnoud et al. | 73/84 |
| 4,583,595 | 4/1986 | Czernichow et al. | 166/264 |
| 4,787,447 | 11/1988 | Christensen | 166/169 |
| 4,804,050 | 2/1989 | Kerfoot | 175/20 |
| 4,807,707 | 2/1989 | Handley et al. | 175/20 |
| 4,878,538 | 11/1989 | Christensen | 166/264 |
| 4,883,123 | 11/1989 | Zunkel et al. | 166/264 |
| 4,940,088 | 7/1990 | Goldschild | 166/109 |
| 5,035,149 | 7/1991 | Wierenga | 73/863.23 |
| 5,125,266 | 6/1992 | Ingram et al. | 73/84 |
| 5,127,261 | 7/1992 | Ingram et al. | 73/84 |
| 5,139,654 | 8/1992 | Carpenter | 210/136 |
| 5,146,998 | 9/1992 | Cordry et al. | 175/21 |
| 5,150,622 | 9/1992 | Vollweiler | 73/864.74 |
| 5,168,765 | 12/1992 | Broussard | 73/864.74 |
| 5,209,129 | 5/1993 | Jaselskis et al. | 73/864.64 |

FOREIGN PATENT DOCUMENTS 913120 3/1982 U.S.S.R. .

OTHER PUBLICATIONS

"A Groundwater Profile Sampler", by E. Hansen et al, Water Resources Research, vol. 10, No. 2, p. 375, Apr. 1974.

"A Probe Method for Soil Water Sampling and Subsurface Measurements", by W. D. Harrison et al, Water Resources Research, vol. 17, No. 6, pp. 1731–1736, Dec. 1981.

*Primary Examiner*—Hoang C. Dang
*Attorney, Agent, or Firm*—Luther A. Marsh

[57] ABSTRACT

An improved module and assembly for sampling liquids and gases within the ground is characterized by module housings containing sampling cavities having lateral openings to the exterior of the housings. Within each lateral opening a removable insert and piston assembly is provided. The piston is displaceable between open and closed positions within the insert in response to changes in pressure from pressure and vacuum sources. When in the closed position, the piston and insert are flush with the exterior of the housing to prevent contaminants from accumulating at the opening. When the module is inserted to a desired depth in the ground, the piston is displaced to the open position and samples from the soil at the desired depth enter the sampling cavity.

16 Claims, 3 Drawing Sheets

MODULAR DEVICE FOR COLLECTING MULTIPLE FLUID SAMPLES FROM SOIL USING A CONE PENETROMETER

The invention described herein may be manufactured and used by or for the Government of the United States of America for governmental purposes without the payment of any royalties thereon or therefor.

BACKGROUND OF THE INVENTION

The present invention relates to the sampling of soil gas and ground water, and more particularly to a multiple sample-taking apparatus for rapidly and accurately obtaining such samples.

Collecting samples of gas or liquid from specific soil depths with a soil penetrometer is typically done by driving a penetrometer hydraulically or by impact to a specific depth and opening a port or screen, and allowing a sample to pass into the penetrometer due to naturally occurring or induced fluid pressure gradients. The present apparatus solves the problem of obtaining a discrete sample of liquid or gas from soil adjacent to a cone penetrometer without having the sample contaminated with soil, liquid or gas from depths other than the depth of each sampling port.

BRIEF DESCRIPTION OF THE PRIOR ART

Soil gas and ground water sampling devices are well-known in the patented prior art as evidenced by the U.S. patents to Handley et al No. 4,807,707, Goldschild No. 4,940,088 and Christensen No. 4,787,447. The Handley et al patent, for example, discloses a sampling system and method for obtaining subsurface samples of soil gas and ground water including a sampling probe which is pushed into the ground with a plurality of thrust rods. The sampling probe has a pointed head telescoped within a sampling housing during probe insertion. When the desired depth is reached, the pointed head is extended, allowing a sample to flow into the housing. A primary drawback of the Handley et al device is that the sampling probe allows for only one soil gas or ground water sample to be taken only at the depth corresponding to the lower end of the probe assembly.

The Goldschild patent discloses a sonde for taking fluid samples including as many sampling modules as there are samples to be taken. These modules are disposed end-to-end, and they are actuated in succession by a central control rod driven back-and-forth by an actuator device situated at the top end of the sonde. The sampling ports for the Goldschild module, however, are not flush with the exterior of each module and tend to carry quantities of soil and/or fluid from shallow ground, thereby contaminating the sample taken at a deeper location.

Certain of the prior liquid or gas samplers have used single ports, while others, such as the modular well fluid sampling apparatus disclosed in the Christensen patent, have used screens. Both the ports or screens are cleaned and sealed while the penetrometer is at the surface. The penetrometer is driven to the required depth and then retracted to allow the port or screen to open and fluid from the soil to flow or be drawn into the penetrometer. One of the major difficulties encountered in these devices is verifying that the seals on the port or screen will function and prevent fluid from depths above the desired depth from entering the penetrometer. Another difficulty is assuring that any latching system holding the port closed operates properly to allow the port to open.

The present invention was developed in order to overcome these and other drawbacks of the prior devices by providing a soil sampler designed so that a penetrometer can be driven to a specific depth, the sampler port opened and a sample of liquid or gas drawn into the penetrometer body in such a way that the sample is not contaminated with fluids, gasses or soil carried by the penetrometer as it penetrates the ground to a desired depth. To achieve this result, the sampler is designed with a series of separate modules each having a sealable port and collecting tubes that are used only one time during the penetration.

SUMMARY OF THE INVENTION

Accordingly, it is a primary object of the present invention to provide a module for sampling soil gas and ground water including a cylindrical housing containing a sampling cavity having an opening extending to the exterior of the housing. A removable hollow insert is located within the sampling cavity adjacent the opening. A piston is arranged within the removable insert and is reciprocated to open and close the sampling port upon actuation of a control mechanism. The control mechanism comprises a fluid pressure source for supplying variable fluid pressure to the sampling cavity via a valve, and a fluid pressure line connected between the source and the sampling cavity.

According to another object of the invention, sensor elements may be placed in the sampling cavity for sensing characteristics of the sample.

It is another object of the invention to form the piston from an inert organic polymer and also to coat the interior surfaces of the sampling module with the polymer in order to protect them from the harmful effects of corrosive compounds in the samples.

According to a further object of the invention, an assembly comprising a plurality of sampling modules having a conical penetrometer connected with the lower end of the modules for penetrating the ground and transporting the modules to a desired sampling depth is provided. The sampling modules are connected in stacked relation along a longitudinal axis, whereby a plurality of samples can be taken by said modules at selected depths.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
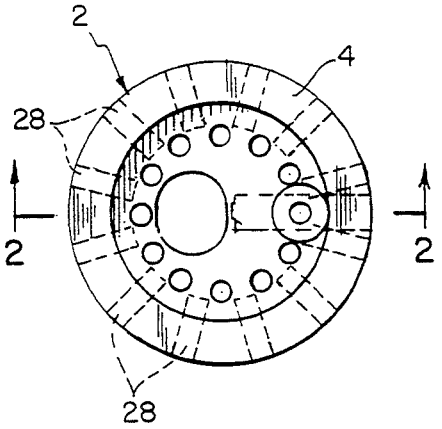
FIG. 1 is a top plan view of a sampling module according to the invention.
Figure 2:
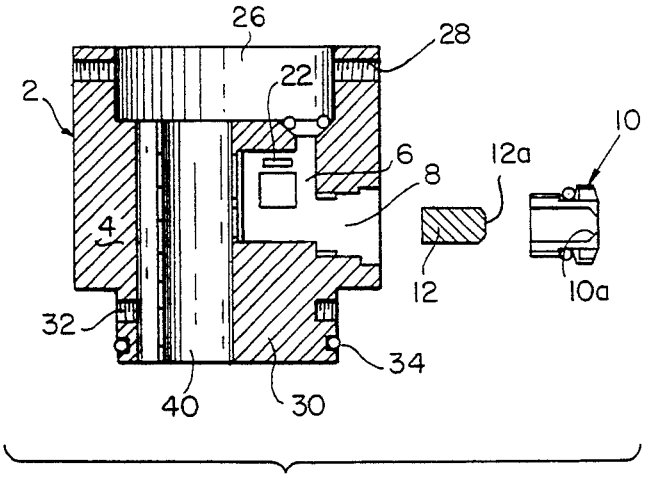
FIG. 2 is a sectional view taken along line 2—2 of FIG. 1 showing the piston and insert removed from the housing.

The sampling module of the present invention for sampling gas and liquid in the ground will first be described with reference to FIGS. 1 and 2. The module 2 includes a cylindrical housing 4 containing a sampling cavity 6. The cavity includes a transverse passage or opening 8 which extends to the exterior of the module as shown in FIG. 1.

Figure 3A:
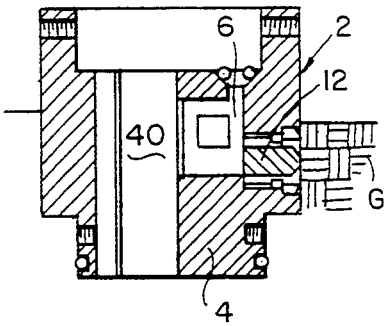
FIGS. 3*a* to 3*c* are sectional views of a sampling module showing the piston in closed, intermediate, and open positions, respectively.
Figure 3B:
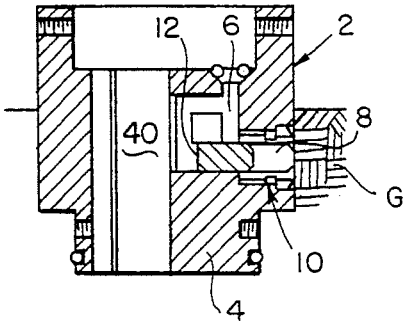
Figure 3C:
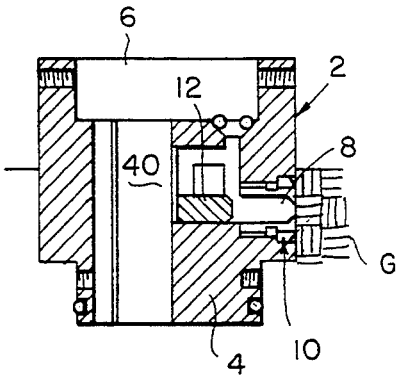

An insert 10 is removably connected with the housing within the transverse opening 8 as shown in FIGS. 3*a*–3*c*. The insert contains a cylindrical chamber configured to receive a piston 12 which reciprocates within the insert between a closed position (FIG. 3*a*) and an open position (FIG. 3*c*) with respect to the opening. A characterizing feature of the invention is the arrangement of the piston when in the closed position. More particularly, the insert 10 has an inner lip portion 10*a* which prevents movement of the piston 12 outside of the opening 8 beyond the exterior surface of the housing. Thus, when the piston is in the closed position, the outer surface 12*a* of the piston is flush with the exterior surface of the housing for a purpose which will be explained in greater detail below.

Movement of the piston 12 between the open and closed positions is controlled by varying the fluid pressure within the sampling cavity. According to a preferred embodiment shown in FIG. 4, a fluid pressure line 14 is connected between the sampling cavity 6 and vacuum 16 and pressure 18 sources. Valves 20 are arranged in the pressure line 14 to control whether air pressure is being supplied to the sampling cavity to displace the piston to its closed position or whether a vacuum is provided in the sampling cavity to displace the piston to its open position.

When the piston 12 is in the closed position and the sampling module is driven to a desired depth into the ground, contaminants from soil, liquids, and gases at depths above the desired level are prevented from entering the sampling cavity 6 because of the flush arrangement of the piston surface 12*a* with the housing exterior surface. At the desired depth, a vacuum from the vacuum source 16 is provided to the cavity to draw the piston to intermediate (FIG. 3*b*) or open positions which enables gas and/or fluid samples from the soil at the depth of the module to enter the sampling cavity. Within the cavity, sensors 22 are provided for sensing characteristics of the sample for chemical analysis.

Figure 4:
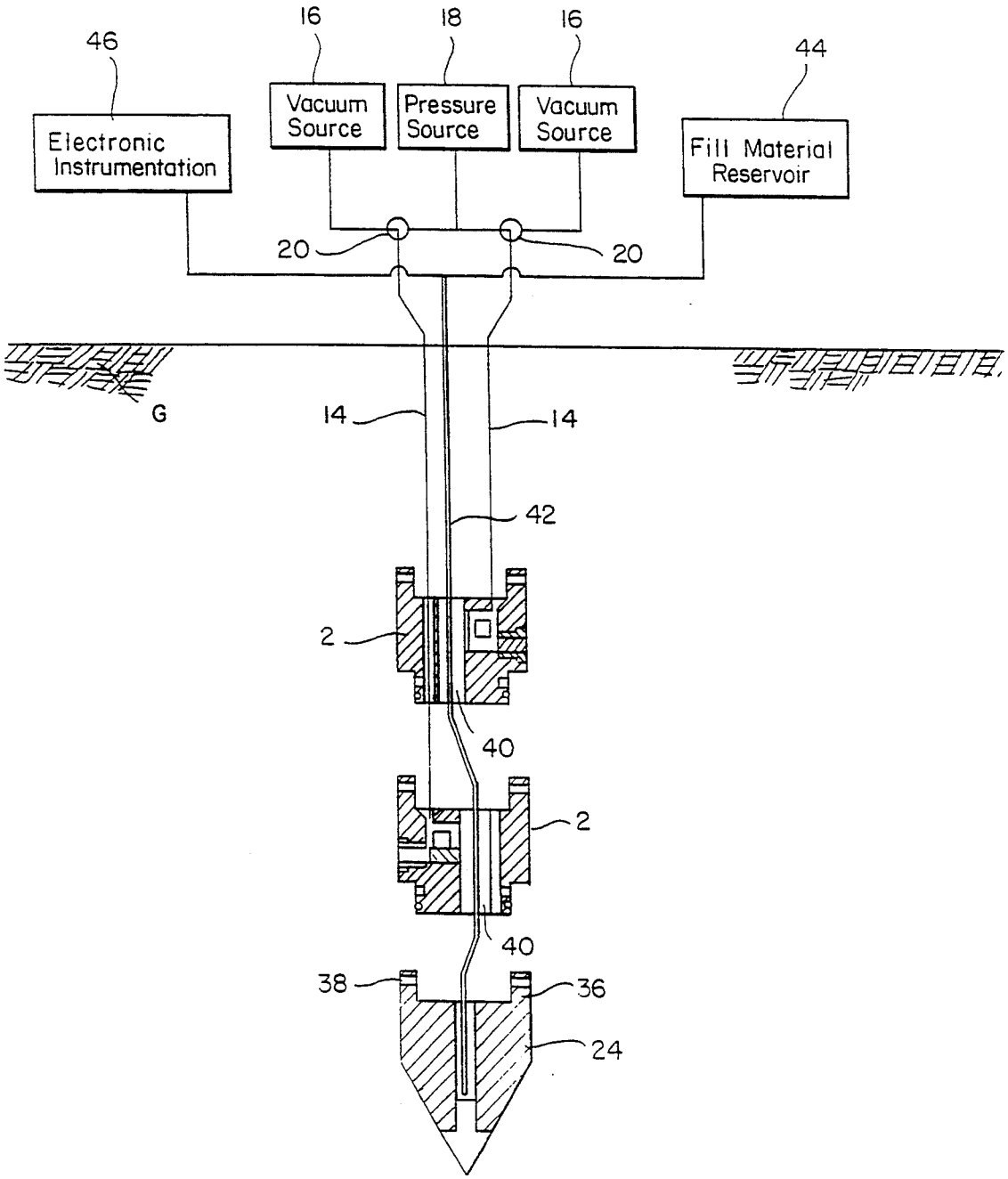
FIG. 4 is a partial sectional exploded view of an assembly for collecting multiple fluid samples from soil according to the invention.
Figure 5:
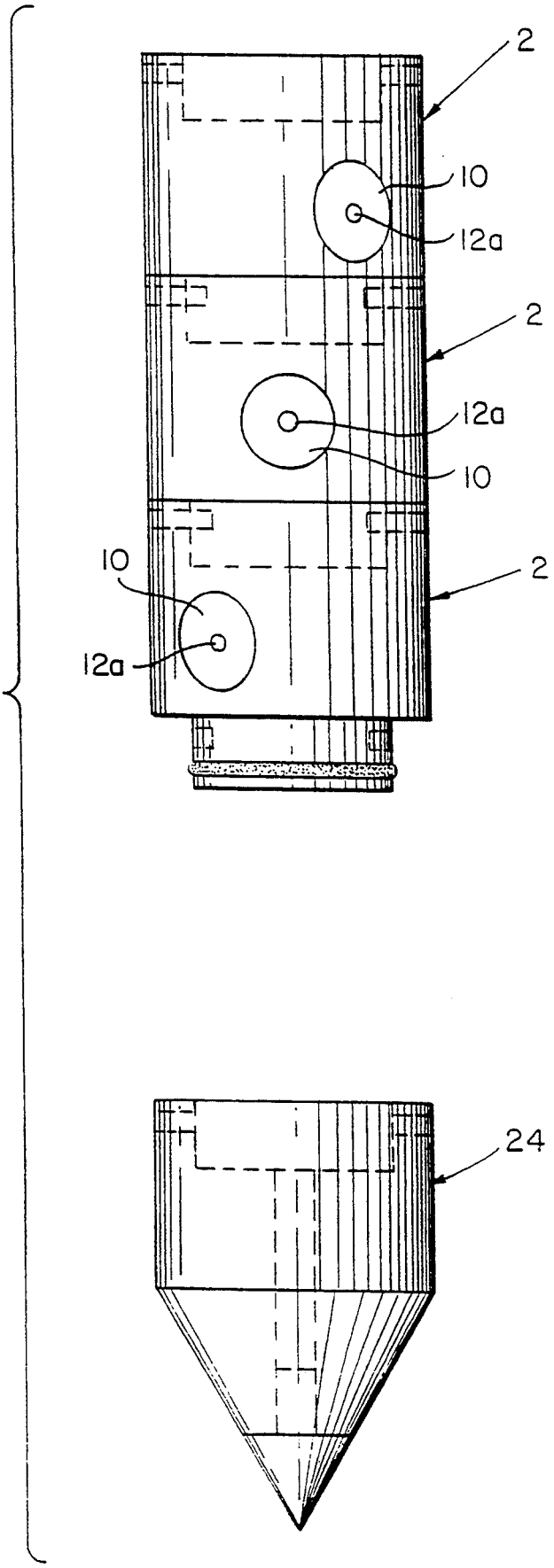
FIG. 5 is a side plan view of three sampling modules in a stacked relationship for connection with a conical penetrometer.

Preferably, a plurality of modules are stacked together and connected with a conical penetrometer 24 as shown in FIGS. 4 and 5 to provide a sampling assembly capable of successively or simultaneously taking a plurality of samples at different depths with only a single push or insertion of the penetrometer into the ground G. For this reason, each module includes an upper annular rim 26 containing openings 28 and a lower cylindrical projection 30 containing threaded openings 32. The lower projection 30 of an upper module is inserted within the rim of a lower adjacent module with the threaded openings 28, 32 aligned and screws (not shown) are threaded into the openings to connect adjacent modules together. An O-ring 34 or other suitable seal is provided in a recess in the lower projection of each module to provide an effective seal between adjacent modules. Any number of modules may be stacked in accordance with the number of samples to be taken.

The penetrometer 24 also includes an annular rim 36 containing openings 38 for connection with the lowermost module in a manner similar to the interconnection of the various modules.

The vacuum 16 and pressure 18 sources and the valves 20 can be connected with multiple pressure lines 14 to individually control the displacement of the pistons within each sample for taking multiple samples within the ground. After the samples have been taken, the assembly is withdrawn from the ground, normally leaving a void in the ground. For filling this void as the assembly is withdrawn, each module and the penetrometer include vertical passages 40 through which a tube 42 is passed to deposit fill material from a reservoir 44.

Electronic instrumentation 46 is provided to receive signals generated from the sensors in the samples or in the penetrometer.

The penetrometer, modules, and insert are preferably formed of a hardened steel material. Because the inserts are removably connected with the module housings, they may readily be disassembled for cleaning. The piston is preferably formed of an inert polymer material and the sampling cavity is preferably coated with the same material to resist corrosion from toxic materials.

OPERATION

Before an assembly including a plurality of sampling modules 2 is used, each of the fluid pressure tubes 14 and sampling cavities 6 is cleaned and flushed with a suitable solvent and dried. For each sampling module, the piston 12 is positioned behind the opening in the sampling cavity insert 10. The tubing 14 to the surface is pressurized up to approximately 100 lbs/sq. inch by adjusting the valves 20 so that gas pressure rises, forcing the piston 12 against the insert lip 10*a*, thereby positively closing the sampling cavity opening. This flush, closed arrangement prevents gas, liquid and soil from shallow ground from attaching itself to or contaminating the sampling cavity opening.

The penetrometer is then driven into the ground until the sampling modules have reached the desired depths. The pistons are maintained in the closed position by the fluid pressure of 100 lbs./sq. inch in the sampling cavity 6. At the desired depths, the valves 20 are adjusted so that a pressure of negative 5 lbs./sq. inch (i.e. a vacuum) is applied to the fluid pressure lines 14 and sampling cavities 6. In response to this new pressure, the pistons begin to retract into the sampling cavities as shown in FIG. 3*b*. The piston 4 stops at the open position of FIG. 3*c* which allows a sample to be drawn into the sampling cavity 6.

When all of the samples have been taken, the assembly is withdrawn from the ground and fill material is pumped into the resulting hole via the penetrometer.

While in accordance with the provisions of the patent statute the preferred forms and embodiments have been illustrated and described, it will be apparent to those of ordinary skill in the art that various changes and modifications may be made without deviating from the inventive concepts set forth above.

What is claimed is:

1. A module for sampling gas and fluid in the ground, comprising:

(a) a cylindrical housing containing a sampling cavity having an opening extending to the exterior of said housing;

(b) a piston horizontally slidably arranged within said housing for reciprocal movement between a closed position, wherein an outer surface of said piston is flush with an exterior surface of said housing, and an open position, wherein said piston is spaced from said housing outer surface to open said sampling opening; and (c) means for displacing said piston between the open and closed positions, whereby when said piston is in the closed position and said module is driven into the ground, debris is prevented from contaminating said sampling opening, and when said piston is displaced to the open positions, gas and liquid from the soil at the depth of said module is drawn into said sampling cavity via the opening for analysis.

2. A sampling module as defined in claim 1, wherein said housing contains a removable hollow insert which is arranged in said sampling cavity adjacent said opening, said insert having an outer surface which is flush with the exterior of said housing and said piston being displaceable within said insert, whereby both said insert and said piston may be removed from said housing for cleaning said sampling cavity and opening.

3. A sampling module as defined in claim 2, wherein said displacing means comprises fluid pressure source means for supplying variable fluid pressure, and a fluid pressure line connected between said source means and said sampling cavity, whereby changes in pressure from said pressure source means displace said piston between the open and closed positions with respect to said opening.

4. A sampling module as defined in claim 3, wherein said fluid pressure source means includes (a) a pressurized fluid source;

(b) a vacuum source; and (c) valve means for alternately connecting said pressurized fluid source and said vacuum source with said fluid pressure line.

5. A sampling module as defined in claim 3, wherein said housing includes connector means at its upper and lower portions for interconnecting a plurality of adjacent modules in a vertical assembly.

6. A sampling module as defined in claim 5, wherein said housing lower portion includes means for sealing the connection between adjacent modules.

7. A sampling module as defined in claim 6, wherein said housing contains a longitudinal passage through which fill material may be passed to fill a hole created when said module is withdrawn from the ground.

8. A sampling module as defined in claim 3, and further comprising sensor means arranged in said sampling cavity for sensing characteristics of the sample.

9. A sampling module as defined in claim 8, wherein said housing includes interior surfaces defining said sampling cavity, said interior surfaces being coated with a solid, inert organic polymer material for protection from toxic metals.

10. A sampling module as defined in claim 9, wherein said piston is formed from an inert polymer material.

11. An assembly for penetrating the earth and sampling gas and fluid in the ground, comprising (a) at least one sampling module including:

(1) a cylindrical housing containing a sampling cavity having an opening extending to the exterior of said housing;

(2) a piston horizontally slidably arranged within said housing for reciprocal movement between a closed position, wherein an outer surface of said piston is flush with an exterior surface of said housing, and an open position, wherein said piston is spaced from said housing outer surface to open said sampling opening; and (3) means for displacing said piston between the open and closed positions; and (b) a conical penetrometer connected with the lower end of said module for penetrating the ground and transporting said module to a desired sampling depth, whereby when said piston is in the closed position and said module is driven into the ground, debris is prevented from contaminating said sampling opening, and when said piston is displaced to the open position, gas and liquid from the soil at the depth of said module is drawn into said sampling cavity via the opening for analysis.

12. A sampling assembly as defined in claim 11, wherein said assembly includes a plurality of sampling modules connected in stacked relation along a longitudinal axis, whereby a plurality of samples can be taken by said modules at selected depths.

13. A sampling assembly as defined in claim 12, wherein each of said module housings contains a removable insert which is arranged in said sampling cavity adjacent said opening, said insert having an outer surface which is flush with the exterior of said housing, said piston being displaceable within said insert, whereby both said insert and said piston may be removed from said housing for cleaning said sampling cavity and opening.

14. A sampling assembly as defined in claim 13, wherein each of said module housings contains a plurality of longitudinal passages.

15. A sampling assembly as defined in claim 14, wherein said piston displacing means comprises fluid pressure source means for supplying variable fluid pressure, and fluid pressure lines passing through said passages of intermediate sampling modules while connecting said source means with each of said sampling cavities, whereby changes in pressure from said pressure source means displace each of said pistons between the open and closed positions with respect to said openings of said modules.

16. A sampling assembly as defined in claim 15, wherein said piston displacing means comprises (a) a pressurized fluid source;

(b) a vacuum source; and (c) valve means for alternately connecting said pressurized fluid source and said vacuum source with said fluid pressure lines.

* * * * *